US011308967B2

(12) United States Patent
Seo et al.

(10) Patent No.: US 11,308,967 B2
(45) Date of Patent: Apr. 19, 2022

(54) AUDIO SIGNAL PROCESSING METHOD AND APPARATUS USING AMBISONICS SIGNAL

(71) Applicant: GAUDIO LAB, INC., Seoul (KR)

(72) Inventors: Jeonghun Seo, Seoul (KR); Sangbae Chon, Seoul (KR)

(73) Assignee: GAUDIO LAB, INC., Seoul (KR)

( * ) Notice: Subject to any disclaimer, the term of this patent is extended or adjusted under 35 U.S.C. 154(b) by 261 days.

(21) Appl. No.: 16/784,259

(22) Filed: Feb. 7, 2020

(65) Prior Publication Data

US 2020/0175997 A1 Jun. 4, 2020

Related U.S. Application Data

(63) Continuation of application No. PCT/KR2018/009285, filed on Aug. 13, 2017.

(30) Foreign Application Priority Data

Aug. 17, 2017 (KR) ..... 10-2017-0103988
May 16, 2018 (KR) ..... 10-2018-0055821

(51) Int. Cl.

| | |
|---|---|
| ***H04R 5/02*** | (2006.01) |
| ***G10L 19/008*** | (2013.01) |
| ***G10L 19/02*** | (2013.01) |
| ***G10L 21/038*** | (2013.01) |
| *H04R 5/04* | (2006.01) |

(52) U.S. Cl.

CPC ..... *G10L 19/008* (2013.01); *G10L 19/0204* (2013.01); *G10L 21/038* (2013.01); *H04R 5/04* (2013.01)

(58) Field of Classification Search

CPC ... G10H 2210/046; G10H 1/08; G10H 1/0091
USPC ..... 381/306–307, 118–119
See application file for complete search history.

(56) References Cited

U.S. PATENT DOCUMENTS

2016/0050508 A1* 2/2016 Redmann ..... H04S 7/302 381/303

FOREIGN PATENT DOCUMENTS

| | | | |
|---|---|---|---|
| KR | 10-2007-0053598 | A | 5/2007 |
| KR | 10-0737302 | B1 | 7/2007 |
| KR | 10-2009-0109489 | A | 10/2009 |
| KR | 10-1271069 | B1 | 6/2013 |
| KR | 10-1439205 | B1 | 9/2014 |

(Continued)

OTHER PUBLICATIONS

International Search Report and Written Opinion of the International Searching Authority dated Jan. 9, 2019 for Application No. PCT/KR2018/009285, 15pages.

(Continued)

*Primary Examiner* — George C Monikang
(74) *Attorney, Agent, or Firm* — Park, Kim & Suh, LLC

(57) ABSTRACT

Disclosed is an audio signal processing apparatus for rendering an input audio signal. The audio signal processing apparatus may include a processor configured to obtain an input audio signal including an ambisonics signal and a non-diegetic channel difference signal, render the ambisonics signal to generate a first output audio signal, mix the first output audio signal and the non-diegetic channel difference signal to generate a second output audio signal, and output the second output audio signal.

20 Claims, 7 Drawing Sheets

(56) References Cited

FOREIGN PATENT DOCUMENTS

| | | | |
|---|---|---|---|
| KR | 10-2016-0015245 | A | 2/2016 |
| KR | 10-2017-0023017 | A | 3/2017 |

OTHER PUBLICATIONS

Korean Office Action in Appln. No. 10-2018-7033032 dated Sep. 30, 2019, 13pages.

* cited by examiner

AUDIO SIGNAL PROCESSING METHOD AND APPARATUS USING AMBISONICS SIGNAL

CROSS-REFERENCE TO RELATED APPLICATIONS

This application claims the benefit under 35 U.S.C. § 120 and § 365(c) to a prior PCT International Application No. PCT/KR2018/009285, filed on Aug. 13, 2018, which claims the benefits of Korean Patent Application No. 10-2017-0103988, filed on Aug. 17, 2017, and Korean Patent Application No. 10-2018-0055821, filed on May 16, 2018, the entire contents of which are incorporated herein by reference.

TECHNICAL FIELD

The present disclosure relates to an audio signal processing method and apparatus, and more specifically, to an audio signal processing method and apparatus providing immersive sound for a portable device including a head mounted display (HMD) device.

BACKGROUND ART

In order to provide immersive and interactive audio in a head mounted display (HMD) device, a binaural rendering technology is essentially required. A technology for reproducing spatial sound corresponding to virtual reality (VR) is an important factor for increasing the realism of the virtual reality and allowing a VR device user to feel completely immersed therein. Audio signals rendered to reproduce spatial sound in virtual reality may be divided into diegetic audio signals and non-diegetic audio signals. Here, the diegetic audio signal may be an audio signal interactively rendered using information of the head orientation and the position of the user. In addition, the non-diegetic audio signal may be an audio signal in which directionality is not important or sound effect according to sound quality is more important than the localization of a sound.

Meanwhile, in a mobile device subject to the limitations of an amount of computation and power consumption, the burden of the amount of computation and power consumption may occur due to an increase in objects or channels subjected to rendering. In addition, the number of encoding streams in a decodable audio format supported by the majority of user equipment and playback software provided in the current multimedia service market may be limited. In this case, user equipment may receive a non-diegetic audio signal separately from a diegetic audio signal and provide the same to a user. Alternatively, user equipment may provide multimedia service in which a non-diegetic audio signal is omitted to the user. Accordingly, a technology for improving the efficiency of processing a diegetic audio signal and a non-diegetic audio signal is required.

DISCLOSURE OF THE INVENTION

Technical Problem

An embodiment of the present disclosure is to efficiently transmit an audio signal having various characteristics required to reproduce realistic spatial sound. In addition, an embodiment of the present disclosure is to transmit an audio signal including a non-diegetic channel audio signal as an audio signal for reproducing a diegetic effect and a non-diegetic effect through an audio format limited in the number of encoding streams.

Technical Solution

An audio signal processing apparatus for generating an output audio signal according to an embodiment of the present disclosure may include a processor configured to obtain an input audio signal including a first ambisonics signal and a non-diegetic channel signal, generate a second ambisonics signal including only a signal corresponding to a predetermined signal component among a plurality of signal components included in an ambisonics format of the first ambisonics signal based on the non-diegetic channel signal, and generate an output audio signal including a third ambisonics signal obtained by synthesizing the second ambisonics signal and the first ambisonics signal for each signal component. In this case, the non-diegetic channel signal may represent an audio signal forming an audio scene fixed with respect to a listener.

Also, the predetermined signal component may be a signal component representing the sound pressure of a sound field at a point at which an ambisonics signal has been collected.

The processor may be configured to filter the non-diegetic channel signal with a first filter to generate the second ambisonics signal. In this case, the first filter may be an inverse filter of a second filter which is for binaural rendering the third ambisonics signal into an output audio signal in an output device which has received the third ambisonics signal.

The processor may be configured to obtain information on a plurality of virtual channels arranged in a virtual space in which the output audio signal is simulated and generate the first filter based on the information of the plurality of virtual channels. In this case, the information of the plurality of virtual channels may be a plurality of virtual channels used for rendering the third ambisonics signal.

The information of the plurality of virtual channels may include position information representing the position of each of the plurality of virtual channels. In this case, the processor may be configured to obtain a plurality of binaural filters corresponding to the position of each of the plurality of virtual channels based on the position information and generate the first filter based on the plurality of binaural filters.

The processor may be configured to generate the first filter based on the sum of filter coefficients included in the plurality of binaural filters.

The processor may be configured to generate the first filter based on the result of an inverse operation of the sum of the filter coefficients and a number of the plurality of virtual channels.

The second filter may include a plurality of binaural filters for each signal component respectively corresponding to each signal component included in an ambisonics signal. Also, the first filter may be an inverse filter of a binaural filter corresponding to the predetermined signal component among the plurality of binaural filters for each signal component. A frequency response of the first filter may be a response having a constant magnitude in a frequency domain.

The non-diegetic channel signal may be a 2-channel signal composed of a first channel signal and a second channel signal. In this case, the processor may be configured to generate a difference signal between the first channel signal and the second channel signal and generate the output audio signal including the difference signal and the third ambisonics signal.

The processor may be configured to generate the second ambisonics signal based on a signal obtained by synthesizing the first channel signal and the second channel signal in a time domain.

The first channel signal and the second channel signal may be channel signals corresponding to different regions with respect to a plane dividing a virtual space in which the second output audio signal is simulated into two regions.

The processor may be configured to encode the output audio signal to generate a bitstream and transmit the generated bitstream to an output device. Also, the output device may be a device for rendering an audio signal generated by decoding the bitstream. When the number of encoding streams used for the generation of the bitstream is N, the output audio signal may include the third ambisonics signal composed of N−1 signal components corresponding to N−1 encoding streams and the difference signal corresponding to one encoding stream.

Specifically, the maximum number of encoding streams supported by a codec used for the generation of the bitstream may be five.

A method for operating an audio signal processing apparatus for generating an output audio signal according to another embodiment of the present disclosure may include obtaining an input audio signal including a first ambisonics signal and a non-diegetic channel difference signal, generating a second ambisonics signal including only a signal corresponding to a predetermined signal component among a plurality of signal components included in an ambisonics format of the first ambisonics signal based on the non-diegetic channel signal, and generating an output audio signal including a third ambisonics signal obtained by synthesizing the second ambisonics signal and the first ambisonics signal for each signal component. In this case, the non-diegetic channel signal may represent an audio signal forming an audio scene fixed with respect to a listener. Also, the predetermined signal component may be a signal component representing the sound pressure of a sound field at a point at which an ambisonics signal has been collected.

According to another embodiment of the present invention, an audio signal processing apparatus for rendering an input audio signal may include a processor configured to obtain an input audio signal including an ambisonics signal and a non-diegetic channel difference signal, render the ambisonics signal to generate a first output audio signal, mix the first output audio signal and the non-diegetic channel difference signal to generate a second output audio signal, and outputs the second output audio signal. In this case, the non-diegetic channel difference signal may be a difference signal representing the difference between a first channel signal and a second channel signal constituting a 2-channel audio signal. In addition, each of the first channel signal and the second channel signal may be an audio signal forming an audio scene fixed with respect to a listener.

The ambisonics signal may include a non-diegetic ambisonics signal generated based on a signal obtained by synthesizing the first channel signal and the second channel signal. In this case, the non-diegetic ambisonics signal may include only a signal corresponding to a predetermined signal component among a plurality of signal components included in an ambisonics format of the ambisonics signal. Also, the predetermined signal component may be a signal component representing the sound pressure of a sound field at a point at which an ambisonics signal has been collected.

Specifically, the non-diegetic ambisonics signal may be a signal obtained by filtering, with a first filter, a signal which has been obtained by synthesizing the first channel signal and the second channel signal in a time domain. In this case, the first filter may be an inverse filter of a second filter which is for binaural rendering the ambisonics signal into the first output audio signal.

The first filter may be generated based on information on a plurality of virtual channels arranged in a virtual space in which the first output audio signal is simulated.

The information of the plurality of virtual channels may include position information representing the position of each of the plurality of virtual channels. In this case, the first filter may be generated based on a plurality of binaural filters corresponding to the position of each of the plurality of virtual channels. In addition, the plurality of binaural filters may be determined based on the position information.

The first filter may be generated based on the sum of filter coefficients included in the plurality of binaural filters.

The first filter may be generated based on the result of an inverse calculation of the sum of filter coefficients and the number of the plurality of virtual channels.

The second filter may include a plurality of binaural filters for each signal component respectively corresponding to each signal component included in the ambisonics signal. Also, the first filter may be an inverse filter of a binaural filter corresponding to the predetermined signal component among the plurality of binaural filters for each signal component. In this case, a frequency response of the first filter may have a constant magnitude in a frequency domain.

The processor may be configured to binaural render the ambisonics signal based on the information of the plurality of virtual channels arranged in the virtual space to generate the first output audio signal and mix the first output audio signal and the non-diegetic channel difference signal to generate the second output audio signal.

The second output audio signal may include a plurality of output audio signals respectively corresponding to each of a plurality of channels according to a predetermined channel layout. In this case, the processor may be configured to generate the first output audio signal including a plurality of output channel signals respectively corresponding to each of the plurality of channels by channel rendering on the ambisonics signal based on position information representing positions respectively corresponding to each of the plurality of channels, and for each channel, may generate the second output audio signal by mixing the first output audio signal and the non-diegetic channel difference signal based on the position information. Each of the plurality of output channel signals may include an audio signal obtained by synthesizing the first channel signal and the second channel signal.

A median plane may represent a plane perpendicular to a horizontal plane of the predetermined channel layout and having the same center with the horizontal plane. In this case, the processor may be configured to generate the second output audio signal by mixing the non-diegetic channel difference signal with the first output audio signal in a different manner for each of a channel corresponding to a left side with respect to the median plane, a channel corresponding to a right side with respect to the median plane, and a channel the corresponding to the median plane among the plurality of channels.

The processor may be configured to decode a bitstream to obtain the input audio signal. In this case, the maximum number of streams supported by a codec used for the generation of the bitstream is N, and the bitstream may be generated based on the ambisonics signal composed of N−1 signal components corresponding to N−1 streams and the non-diegetic channel difference signal corresponding to one stream. In addition, the maximum number of streams supported by the codec of the bitstream may be five.

The first channel signal and the second channel signal may be channel signals corresponding to different regions with respect to a plane dividing a virtual space in which the second output audio signal is simulated into two regions. In addition, the first output audio signal may include a signal obtained by synthesizing the first channel signal and the second channel signal.

A method for operating an audio signal processing apparatus for rendering an input audio signal according to another aspect of the present disclosure may include obtaining an input audio signal including an ambisonics signal and a non-diegetic channel difference signal, rendering the ambisonics signal to generate a first output audio signal, mixing the first output audio signal and the non-diegetic channel difference signal to generate a second output audio signal, and outputting the second output audio signal. In this case, the non-diegetic channel difference signal may be a difference signal representing a difference between a first channel signal and a second channel signal constituting a 2-channel audio signal, and the first channel signal and the second channel signal may be audio signals forming an audio scene fixed with respect to a listener.

An electronic device readable recording medium according to another aspect may include a recording medium in which a program for executing the above-described method in the electronic device is recorded.

Advantageous Effects

An audio signal processing apparatus according to an embodiment of the present disclosure may provide an immersive three-dimensional audio signal. In addition, the audio signal processing apparatus according to an embodiment of the present disclosure may improve the efficiency of processing a non-diegetic audio signal. In addition, the audio signal processing apparatus according to an embodiment of the present disclosure may efficiently transmit an audio signal necessary for reproducing spatial sound through various codes.

MODE FOR CARRYING OUT THE INVENTION

Figure 1:
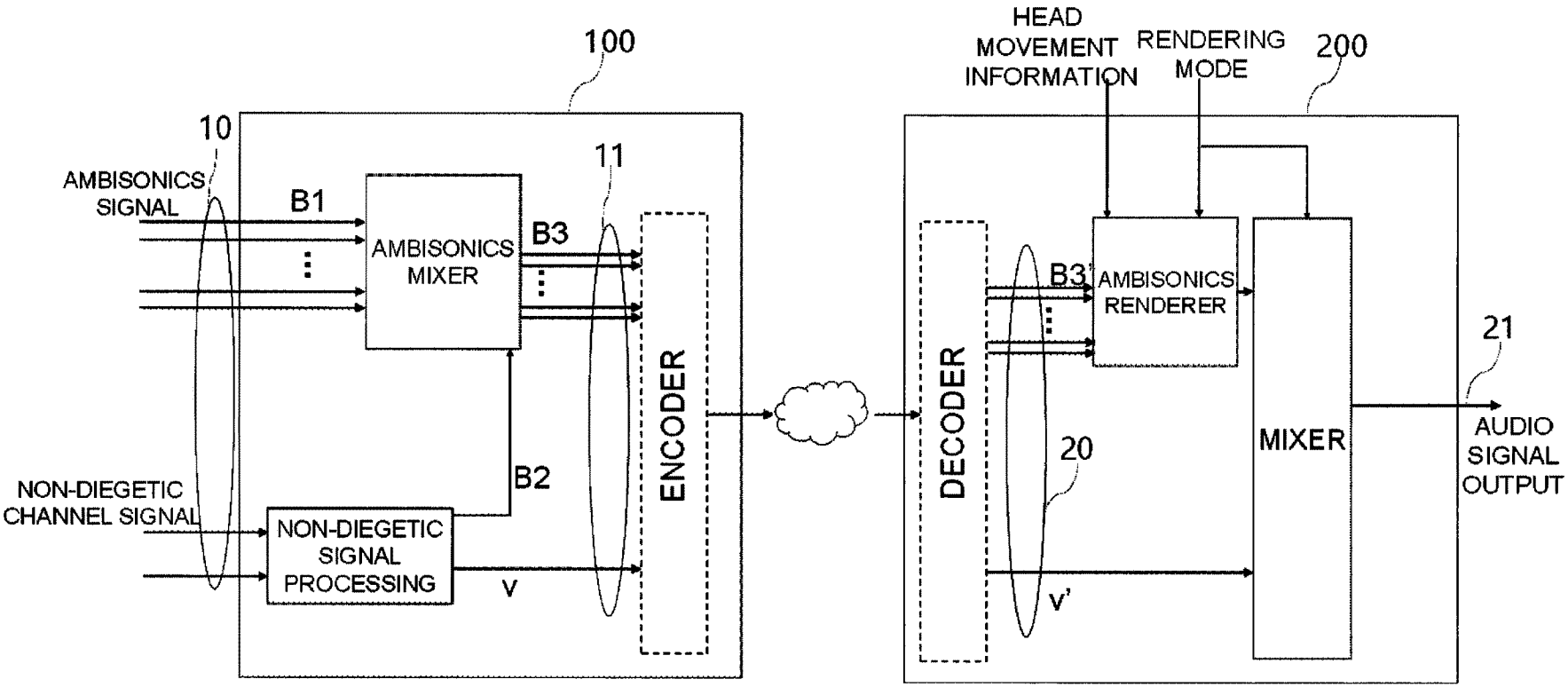
FIG. 1 is a schematic diagram illustrating a system including an audio signal processing apparatus and a rendering apparatus according to an embodiment of the present disclosure.

Hereinafter, embodiments of the present invention will be described in detail with reference to the accompanying drawings so that those skilled in the art may easily carry out the present invention. However, the present invention may be implemented in many different forms and is not limited to the embodiments described herein. Some parts of the embodiments, which are not related to the description, are not illustrated in the drawings to clearly describe the embodiments of the present disclosure and like reference numerals refer to like elements throughout the description.

In addition, when a portion is said to "include" or "comprises" any component, it means that the portion may further include other components rather than excluding the other components unless otherwise stated.

The present disclosure relates to an audio signal processing method for processing an audio signal including a non-diegetic audio signal. The non-diegetic audio signal may be a signal forming an audio scene fixed with respect to a listener. In a virtual space, the directional properties of a sound which is output in correspondence to a non-diegetic audio signal may not change regardless of the motion of the listener. According to the audio signal processing method of the present disclosure, the number of encoding streams for a non-diegetic effect may be reduced while maintaining the sound quality of a non-diegetic audio signal included in an input audio signal. An audio signal processing apparatus according to an embodiment of the present disclosure may filter a non-diegetic channel signal to generate a signal which may be synthesized with a diegetic ambisonics signal. Also, an audio signal processing apparatus 100 may encode an output audio signal including a diegetic audio signal and a non-diegetic audio signal. Through the above, the audio signal processing apparatus 100 may efficiently transmit audio data corresponding to the diegetic audio signal and the non-diegetic audio signal to another apparatus.

Hereinafter the present invention will be described in detail with reference to the accompanying drawings.

FIG. 1 is a schematic diagram illustrating a system including the audio signal processing apparatus 100 and a rendering apparatus 200 according to an embodiment of the present disclosure.

According to an embodiment of the present disclosure, the audio signal processing apparatus 100 may generate a first output audio signal 11 based on a first input audio signal 10. Also, the audio signal processing apparatus 100 may transmit the first output audio signal 11 to the rendering apparatus 200. For example, the audio signal processing apparatus 100 may encode the first output audio signal 11 and transmit the encoded audio data.

According to an embodiment, the first input audio signal 10 may include an ambisonics signal B1 and a non-diegetic channel signal. The audio signal processing apparatus 100 may generate a non-diegetic ambisonics signal B2 based on the non-diegetic channel signal. The audio signal processing apparatus 100 may synthesize the ambisonics signal B1 and the non-diegetic ambisonics signal B2 to generate an output ambisonics signal B3. The first output audio signal 11 may include the output ambisonics signal B3. Also, when the non-diegetic channel signal is a 2-channel signal, the audio signal processing apparatus 100 may generate a difference signal v between channels constituting a non-diegetic channel. In this case, the first output audio signal 11 may include the output ambisonics signal B3 and the difference signal v. Through the above, the audio signal processing apparatus 100 may reduce the number of channels of a channel signal for a non-diegetic effect included in the first output audio signal 11 compared to the number of channels of a non-diegetic channel signal included in the first input audio signal 10. A detailed method for processing a non-diegetic channel signal by the audio signal processing apparatus 100 will be described with reference to FIG. 2 to FIG. 4.

In addition, according to an embodiment, the audio signal processing apparatus 100 may encode the first output audio signal 11 to generate an encoded audio signal. For example, the audio signal processing apparatus 100 may map each of a plurality of signal components included in the output ambisonics signal B3 to a plurality of encoding streams. Also, the audio signal processing apparatus 100 may map the difference signal v to one encoding stream. The audio signal processing apparatus 100 may encode the first output audio signal 11 based on a signal component assigned to an encoding stream. Through the above, even when the number of encoding streams is limited according to a codec, the audio signal processing apparatus 100 may encode a non-diegetic audio signal together with a diegetic audio signal. In this regard, a detailed description will be given with reference to FIG. 7. Through the above, the audio signal processing apparatus 100 according to an embodiment of the present disclosure may transmit encoded audio data to provide a sound including a non-diegetic effect to a user.

According to an embodiment of the present disclosure, the rendering apparatus 200 may obtain a second input audio signal 20. Specifically, the rendering apparatus 200 may receive encoded audio data from the audio signal processing apparatus 100. In addition, the rendering apparatus 200 may decode the encoded audio data to obtain the second input audio signal 20. In this case, depending on an encoding method, the second input audio signal 20 may be different from the first output audio signal 11. Specifically, in the case of audio data encoded by a lossless compression method, the second input audio signal 20 may be the same as the first output audio signal 11. The second input audio signal 20 may include an ambisonics signal B3'. Also, the second input audio signal 20 may further include a difference signal v'.

In addition, the rendering apparatus 200 may render the second input audio signal 20 to generate a second output audio signal 21. For example, the rendering apparatus 200 may perform binaural rendering on some signal components in a second input audio signal to generate a second output audio signal. Alternatively, the rendering apparatus 200 may perform channel rendering on some signal components in a second input audio signal to generate a second output audio signal. A method for generating the second output audio signal 21 by the rendering apparatus 200 will be described later with reference to FIG. 5 and FIG. 6.

Meanwhile, in the present disclosure, the rendering apparatus 200 is described as being a separate apparatus from the audio signal processing apparatus 100, but the present disclosure is not limited thereto. For example, at least some of operations of the rendering apparatus 200 described in the present disclosure may be also performed in the audio signal processing apparatus 100. In addition, in FIG. 1, encoding and decoding operations performed in an encoder of the audio signal processing apparatus 100 and in a decoder of the rendering apparatus 200 can be omitted.

Figure 2:
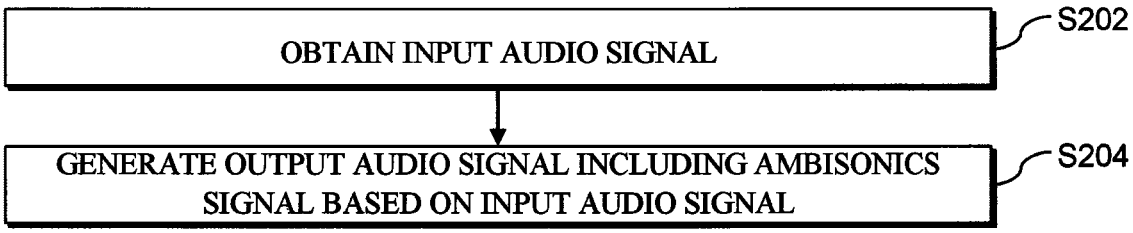
FIG. 2 is a flowchart illustrating an operation of an audio signal processing apparatus according to an embodiment of the present disclosure.

FIG. 2 is a flowchart illustrating an operation of the audio signal processing apparatus 100 according to an embodiment of the present disclosure. In Step S202, the audio signal processing apparatus 100 may obtain an input audio signal. For example, the audio signal processing apparatus 100 may receive an input audio signal collected through one or more sound collecting apparatuses. The input audio signal may include at least one among an ambisonics signal, an object signal, and a loudspeaker channel signal. Here, the ambisonics signal may be a signal recorded through a microphone array including a plurality of microphones. In addition, the ambisonics signal may be represented in an ambisonics format. The ambisonics format may be represented by converting a 360-degree spatial signal recorded through the microphone array into a coefficient for a basis of a spherical harmonics function. Specifically, the ambisonics format may be referred to as a B-format.

In addition, an input audio signal may include at least one of a diegetic audio signal and a non-diegetic audio signal. Here, the diegetic audio signal may be an audio signal in which the position of a sound source corresponding to an audio signal changes according to the motion of a listener in a virtual space in which the audio signal is simulated. For example, the diegetic audio signal may be represented through at least one among the ambisonics signal, the object signal, or the loudspeaker channel signal described above. In addition, the non-diegetic audio signal may be an audio signal forming an audio scene fixed with respect to a listener as described above. Also, the non-diegetic audio signal may be represented through a loudspeaker channel signal. For example, when the non-diegetic audio signal is a 2-channel audio signal, the position of a sound source corresponding to each channel signal constituting the non-diegetic audio signal may be fixed to the positions of both ears of the listener. However, the present disclosure is not limited thereto. In the present disclosure, the loudspeaker channel signal may be referred to as a channel signal for convenience of description. In addition, in the present disclosure, the non-diegetic channel signal may mean a channel signal representing the above-described non-diegetic properties among channel signals.

In Step S204, the audio signal processing apparatus 100 may generate an output audio signal based on the input audio signal obtained through Step S202. According to an embodiment, the input audio signal may include an ambisonics signal and a non-diegetic channel audio signal composed of at least one channel. In this case, the ambisonics signal may be a diegetic ambisonics signal. In this case, the audio signal processing apparatus 100 may generate a non-diegetic ambisonics signal in an ambisonics format based on a non-diegetic channel audio signal. In addition, the audio signal processing apparatus 100 may synthesize a non-diegetic ambisonics signal and an ambisonics signal to generate an output audio signal.

The number N of signal components included in the above-described ambisonics signal may be determined based on the highest order of the ambisonics signal. An m-th order ambisonics signal in which an m-th order is the highest order may include (m+1)^2 signal components. In this case, m may be an integer equal to or greater than 0. For example, when the order of an ambisonics signal included in an output audio signal is 3, the output audio signal may include 16 ambisonics signal components. In addition, the spherical harmonics function described above may vary according to the order m of an ambisonics format. A primary ambisonics signal may be referred to as a first-order ambisonics (FoA). Also, an ambisonics signal having an order of 2 or greater may be referred to as a high-order ambisonics (HoA). In the present disclosure, am ambisonics signal may represent any one of an FoA signal or an HoA signal.

Also, according to an embodiment, the audio signal processing apparatus 100 may output an output audio signal. For example, the audio signal processing apparatus 100 may simulate a sound including a diegetic sound and a non-diegetic sound through the output audio signal. The audio signal processing apparatus 100 may transmit the output audio signal to an external device connected to the audio signal processing apparatus 100. For example, the external device connected to the audio signal processing apparatus 100 may be the rendering apparatus 200. In addition, the audio signal processing apparatus 100 may be connected to the external device through wired/wireless interfaces.

According to an embodiment, the audio signal processing apparatus 100 may output encoded audio data. In the present disclosure, the output of an audio signal may include an operation of transmitting digitized data. Specifically, the audio signal processing apparatus 100 may encode an output audio signal to generate audio data. In this case, encoded audio data may be a bitstream. The audio signal processing apparatus 100 may encode a first output audio signal based on a signal component assigned to an encoding stream. For example, the audio signal processing apparatus 100 may generate a pulse code modulation (PCM) signal for each encoding stream. Also, the audio signal processing apparatus 100 may transmit a plurality of generated PCM signals to the rendering apparatus 200.

According to an embodiment, the audio signal processing apparatus 100 may encode an output audio signal using a codec with a limited maximum number of encodable encoding streams. For example, the maximum number of encoding streams may be limited to 5. In this case, the audio signal processing apparatus 100 may generate an output audio signal composed of 5 signal components based on an input audio signal. For example, the output audio signal may be composed of 4 ambisonics signal components included in an FoA signal and one difference signal component. Next, the audio signal processing apparatus 100 may encode the output audio signal composed of 5 signal components to generate encoded audio data. In addition, the audio signal processing apparatus 100 may transmit the encoded audio data. Meanwhile, the audio signal processing apparatus 100 may compress the encoded audio data through a lossless compression method or a lossy compression method. For example, an encoding process may include a process of compressing audio data.

Figure 3:
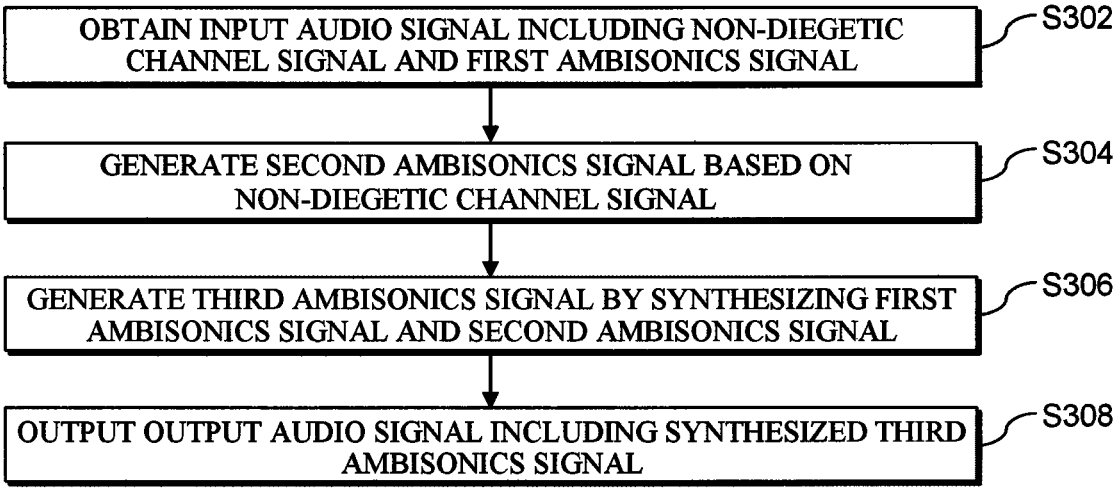
FIG. 3 is a flowchart illustrating a method for processing a non-diegetic channel signal by an audio signal processing apparatus according to an embodiment of the present disclosure.

FIG. 3 is a flowchart illustrating a method for processing a non-diegetic channel signal by the audio signal processing apparatus 100 according to an embodiment of the present disclosure.

In Step S302, the audio signal processing apparatus 100 may obtain an input audio signal including a non-diegetic audio signal and a first ambisonics signal. According to an embodiment, the audio signal processing apparatus 100 may receive a plurality of ambisonics signals having different highest order. In this case, the audio signal processing apparatus 100 may synthesize the plurality of ambisonics signals into one first ambisonics signal. For example, the audio signal processing apparatus 100 may generate a first ambisonics signal in an ambisonics format having the largest highest order among the plurality of ambisonics signals. Alternatively, the audio signal processing apparatus 100 may convert an HoA signal into an FoA signal to generate the first ambisonics signal in a primary ambisonics format.

In Step S304, the audio signal processing apparatus 100 may generate a second ambisonics signal based on the non-diegetic channel signal obtained in Step S302. For example, the audio signal processing apparatus 100 may generate the second ambisonics signal by filtering the non-diegetic ambisonics signal with a first filter. The first filter will be described in detail with reference to FIG. 4.

According to an embodiment, the audio signal processing apparatus 100 may generate a second ambisonics signal including only a signal corresponding to a predetermined signal component among a plurality of signal components included in an ambisonics format of the first ambisonics signal. Here, the predetermined signal component may be a signal component representing the sound pressure of a sound field at a point at which an ambisonics signal has been collected. In this case, the predetermined signal component may not exhibit directivity toward a specific direction in a virtual space in which the ambisonics signal is simulated. In addition, the second ambisonics signal may be a signal whose signal value corresponding to another signal component other than the predetermined signal component is '0'. This is because a non-diegetic audio signal is an audio signal forming an audio scene fixed with respect to the listener. In addition, the tone of the non-diegetic audio signal may be maintained regardless of the head movement of a listener.

For example, a FoA signal B may be represented by [Equation 1]. W, X, Y, and Z contained in the FoA signal B may represent signals respectively corresponding to each of four signal components contained in the FoA.

$$B=[W,X,Y,Z]^T \quad \text{[Equation 1]}$$

In this case, the second ambisonics signal may be represented as $[2, 0, 0, 0]^T$ containing only a W component. In [Equation 1], $[x]^T$ represents the transpose matrix of a matrix [x]. The predetermined signal component may be a first signal component w corresponding to a 0-th order ambisonics format. In this case, the first signal component w may be a signal component representing the sound pressure of a sound field at a point at which an ambisonics signal has been collected. Also, the first signal component may be a signal component having a value not changing even when the matrix B representing the ambisonics signal is rotated in accordance with the head movement information of a listener.

As described above, the m-th ambisonics signal may include (m+1)^2 signal components. For example, a 0-th order ambisonics signal may contain one first signal component w. In addition, a first order ambisonics signal may contain second to fourth signal components x, y, and z in addition to the first signal component w. Also, each of signal components included in an ambisonics signal may be referred to as an ambisonics channel. An ambisonics format may include a signal component corresponding to at least one ambisonics channel for each order. For example, a 0-th order ambisonics format may include one ambisonics channel. A predetermined signal component may be a signal component corresponding to the 0-th order ambisonics format. According to an embodiment, when the highest order of the first ambisonics signal is the first order, the second ambisonics signal may be an ambisonics signal having a value corresponding to the second to fourth signal components of '0'.

According to an embodiment, when a non-diegetic channel signal is a 2-channel signal, the audio signal processing apparatus 100 may generate a second ambisonics signal based on a signal obtained by synthesizing channel signals constituting the non-diegetic channel signal in a time domain. For example, the audio signal processing apparatus 100 may generate the second ambisonics signal by filtering the sum of channel signals constituting the non-diegetic ambisonics signal with a first filter.

In Step S306, the audio signal processing apparatus 100 may generate a third ambisonics signal by synthesizing the first ambisonics signal and the second ambisonics signal. For example, the audio signal processing apparatus 100 may synthesize the first ambisonics signal and the second ambisonics signal for each signal component.

Specifically, when the first ambisonics signal is a first-order ambisonics signal, the audio signal processing apparatus 100 may synthesize a first signal of the first ambisonics signal corresponding to the first signal component w described above and a second signal of the second ambisonics signal corresponding to the first signal component w. In addition, the audio signal processing apparatus 100 may bypass the synthesis operation of second to fourth signal components. This is because the value of the second to fourth signal components of the second ambisonics signal may be '0'.

In Step S308, the audio signal processing apparatus 100 may output an output audio signal including the third ambisonics signal which has been synthesized. For example, the audio signal processing apparatus 100 may transmit the output audio signal to the rendering apparatus 200.

Meanwhile, when a non-diegetic channel signal is a 2-channel signal, the output audio signal may include the third ambisonics signal and a difference signal between channels constituting the non-diegetic channel signal. For example, the audio signal processing apparatus 100 may generate the difference signal based on the non-diegetic channel signal. This is because the rendering apparatus 200 which has received an audio signal from the audio signal processing apparatus 100 may restore the 2-channel non-diegetic channel signal from the third ambisonics signal using the difference signal. A method of restoring the 2-channel non-diegetic channel signal by the rendering apparatus 200 using the difference signal will be described in detail with reference to FIG. 5 and FIG. 6.

Figure 4:
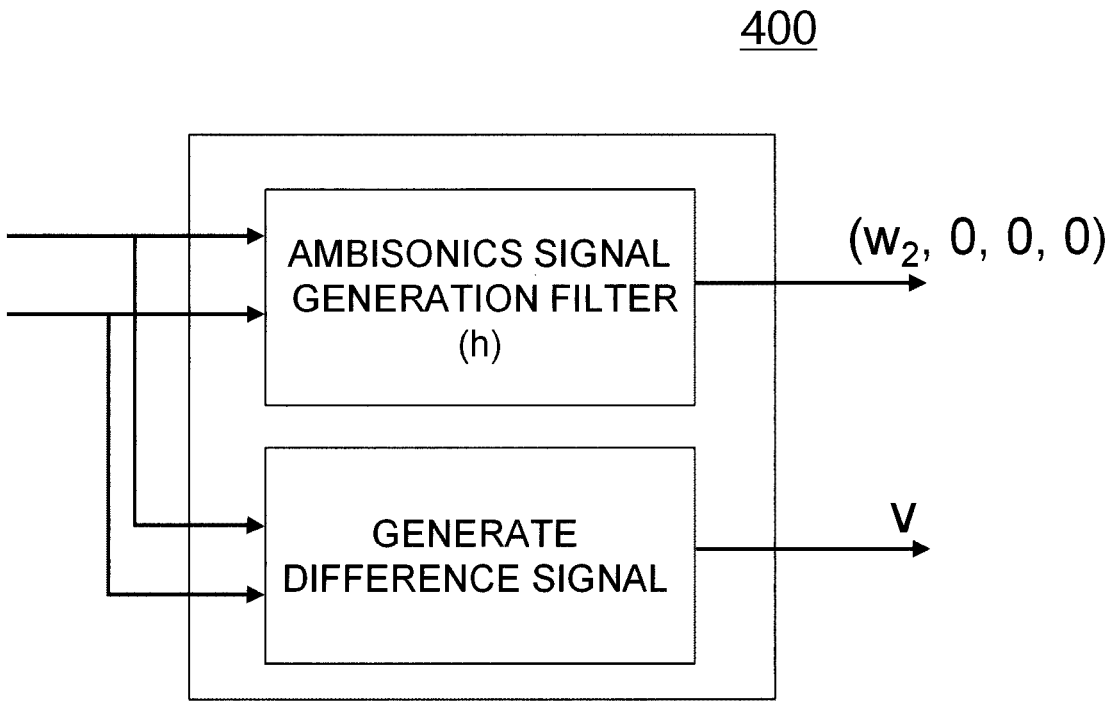
FIG. 4 is a diagram illustrating a non-diegetic channel signal processing by an audio signal processing apparatus according to an embodiment of the present disclosure in detail.

Hereinafter, a method for generating a non-diegetic ambisonics signal based on a non-diegetic channel signal using a first filter by the audio signal processing apparatus 100 according to an embodiment of the present disclosure will be described in detail with reference to FIG. 4 to FIG. 6. FIG. 4 is a diagram illustrating a non-diegetic channel signal processing 400 by the audio signal processing apparatus 100 according to an embodiment of the present disclosure in detail.

According to an embodiment, the audio signal processing apparatus 100 may generate a non-diegetic ambisonics signal by filtering a non-diegetic ambisonics signal with a first filter. In this case, the first filter may be an inverse filter of a second filter which is for rendering an ambisonics signal in the rendering apparatus 200. Here, the ambisonics signal may be an ambisonics signal including the non-diegetic ambisonics signal. For example, the ambisonics signal may be the third ambisonics signal synthesized in Step S306 of FIG. 3.

In addition, the second filter may be a frequency domain filter Hw for rendering the W signal component of the FoA signal of [Equation 1]. In this case, the first filter may be Hw^(−1). This is because in the case of a non-diegetic ambisonics signal, a signal component excluding the W signal component is '0' value. In addition, when the non-diegetic channel signal is a 2-channel signal, the audio signal processing apparatus 100 may generate the non-diegetic ambisonics signal by filtering the sum of channel signals constituting the non-diegetic ambisonics channel signal with Hw^(−1).

According to an embodiment, a first filter may be an inverse filter of a second filter which is for binaural rendering an ambisonics signal in the rendering apparatus 200. In this case, the audio signal processing apparatus 100 may generate the first filter based on a plurality of virtual channels arranged in a virtual space in which an output audio signal including the ambisonics signal is simulated in the rendering device 200. Specifically, the audio signal processing apparatus 100 may obtain information of the plurality of virtual channels used for the rendering of the ambisonics signal. For example, the audio signal processing apparatus 100 may receive the information of the plurality of virtual channels from the rendering apparatus 200. Alternatively, the information of the plurality of virtual channels may be common information pre-stored in each of the audio signal processing apparatus 100 and the rendering apparatus 200.

In addition, the information of the plurality of virtual channels may include position information representing the position of each of the plurality of virtual channels. The audio signal processing apparatus 100 may obtain a plurality of binaural filters corresponding to the position of each of the plurality of virtual channels based on the position information. Here, the binaural filter may include at least one of a transfer function such as Head-Related Transfer function (HRTF), Interaural Transfer Function (ITF), Modified ITF (MITF), and Binaural Room Transfer Function (BRTF) or a filter coefficient such as Room Impulse Response (RIR), Binaural Room Impulse Response (BRIR), and Head Related Impulse Response (HRIR). In addition, the binaural filter may include at least one of a transfer function and data having a modified or edited transfer function, but the present disclosure is not limited thereto.

Also, the audio signal processing apparatus 100 may generate a first filter based on the plurality of binaural filters. For example, the audio signal processing apparatus 100 may generate the first filter based on the sum of filter coefficients included in the plurality of binaural filters. The audio signal processing apparatus 100 may generate the first filter based on the result of the inverse operation of the sum of the filter coefficients. Also, the audio signal processing apparatus 100 may generate the first filter based on the result of the inverse operation of the sum of the filter coefficients and the number of virtual channels. For example, when a non-diegetic channel signal is a 2-channel stereo signal Lnd and Rnd, a non-diegetic ambisonics signal W2 may be represented by [Equation 2].

$$W_2 = (L_{nd} + R_{nd})^* h_0^{-1} \quad \text{[Equation 2]}$$

$$h_o = \frac{2}{K} \cdot \sum_{k=1}^{K} h_k$$

In [Equation 2], $h_0^{-1}$ may represent the first filter and '*' may represent a convolution operation. '·' may represent a multiplication operation. K may be an integer representing the number of virtual channels. In addition, hk may represent the filter coefficient of a binaural filter corresponding to a k-th virtual channel. According to an embodiment, the first filter of [Equation 2] may be generated based on a method to be described with reference to FIG. 5.

Hereinafter, a method for generating a first filter will be described through a process of recovering a non-diegetic ambisonics signal generated based on the first filter into a non-diegetic channel signal. FIG. 5 is a diagram illustrating a method for generating an output audio signal including a non-diegetic channel signal based on an input audio signal including a non-diegetic ambisonics signal by the rendering apparatus 200 according to an embodiment of the present disclosure.

Hereinafter, in the embodiments of FIG. 5 to FIG. 7, for convenience of explanation, an example in which an ambisonics signal is a FoA signal and a non-diegetic channel signal is a 2-channel signal will be described, but the present disclosure is not limited thereto. For example, when the ambisonics signal is a HoA, the operation of the audio signal processing apparatus 100 and the rendering apparatus 200 to be described hereinafter may be applied in the same or corresponding manner. In addition, even when the non-diegetic signal is a mono-channel signal composed of one channel, the operation of the audio signal processing apparatus 100 and the rendering apparatus 200 to be described below may be applied in the same or corresponding manner.

According to an embodiment, the rendering apparatus 200 may generate an output audio signal based on an ambisonics signal converted into a virtual channel signal. For example, the rendering apparatus 200 may convert an ambisonics signal into a virtual channel signal corresponding to each of a plurality of virtual channels. In addition, the rendering apparatus may generate a binaural audio signal or a loudspeaker channel signal based on the converted signal. Specifically, when the number of virtual channels constituting a virtual channel layout is K, position information may represent the position of each of K virtual channels. When an ambisonics signal is a FoA signal, a decoding matrix T1 for converting the ambisonics signal into a virtual channel signal may be represented by [Equation 3].

$$U = \begin{bmatrix} Y_0^0(\theta_l, \varphi_l) & \dots & Y_0^0(\theta_K, \varphi_K) \\ Y_1^{-1}(\theta_l, \varphi_l) & \dots & Y_1^{-1}(\theta_K, \varphi_K) \\ Y_1^0(\theta_l, \varphi_l) & \dots & Y_1^0(\theta_K, \varphi_K) \\ Y_1^1(\theta_l, \varphi_l) & \dots & Y_1^1(\theta_K, \varphi_K) \end{bmatrix} \quad \text{[Equation 3]}$$

$$T = pinv(U)$$

Here, k is an integer between 1 and K.

Here, Ym (theta, phi) may represent a spherical harmonics function at an azimuth angle theta and an elevation angle phi representing the position corresponding to each of the K virtual channels in a virtual space. Also, pinv(U) may represent a pseudo inverse matrix or an inverse matrix of a matrix U. For example, a matrix T1 may be a Moore-Penrose pseudo inverse matrix of the matrix U for converting a virtual channel into a spherical harmonics function domain. In addition, when an ambisonics signal to be subjected to rendering is B, a virtual channel signal C may be represented by [Equation 4]. The audio signal processing apparatus 100 and the rendering apparatus 200 may obtain a virtual channel signal C based on a matrix product between the ambisonics signal B and the decoding matrix T1.

$$C = T1 \cdot B \quad \text{[Equation 4]}$$

According to an embodiment, the rendering apparatus 200 may generate an output audio signal by binaural rendering the ambisonics signal B. In this case, the rendering apparatus 200 may filter a virtual channel signal obtained through [Equation 4] with a binaural filter to obtain a binaural rendered output audio signal. For example, the rendering apparatus 200 may generate an output audio signal by filtering a virtual channel signal with a binaural filter corresponding to the position of each of virtual channels for each virtual channel. Alternatively, the rendering apparatus 200 may generate one binaural filter to be applied to a virtual channel signal based on a plurality of binaural filters corresponding to the position of each of the virtual channels. In this case, the rendering apparatus 200 may generate an output audio signal by filtering a virtual channel signal with one binaural filter. The binaural rendered output audio signals PL and PR may be represented by [Equation 5].

$$P_L = \sum_{k=l}^{K} h_{k,L} * C_k \quad \text{[Equation 5]}$$

$$P_R = \sum_{k=l}^{K} h_{k,R} * C_k$$

In [Equation 5], $h_{k,R}$ and $h_{k,L}$ may respectively represent a filter coefficient of a binaural filter corresponding to a k-th virtual channel. For example, the filter coefficient of a binaural filter may include at least one of the above-described HRIR or BRIR coefficient and a panning coefficient. In addition, in [Equation 5], Ck may represent a virtual channel signal corresponding to the k-th virtual channel, and '*' may mean a convolution operation.

Meanwhile, since a binaural rendering process for an ambisonics signal is based on a linear operation, the process may be independent for each signal component. In addition, signals included in the same signal component may be independently calculated. Accordingly, the first ambisonics signal and the second ambisonics signal (non-diegetic ambisonics signal) synthesized in Step S306 of FIG. 3 may be independently calculated. Hereinafter, a description will be given with reference to a process for processing a non-diegetic ambisonics signal representing the second ambisonics signal generated in Step S304 of FIG. 3. In addition, a non-diegetic audio signal included in a rendered output audio signal may be referred to as a non-diegetic component of the output audio signal.

For example, a non-diegetic ambisonics signal may be [W2, 0, 0, 0]T. In this case, the virtual channel signal Ck converted based on the non-diegetic ambisonics signal may be represented by C1=C2= . . . =CK=W2/K. This is because the W component in an ambisonics signal is a signal component having no directivity toward a specific direction in a virtual space. Accordingly, the non-diegetic components PL and PR of binaural rendered output audio signal may be represented by the total sum of the filter coefficients of binaural filters, the number of virtual channels, and W2 which is the value of the W signal component of the ambisonics signal. In addition, [Equation 5] described above may be represented by [Equation 6]. In [Equation 6], delta (n) may represent a delta function. Specifically, the delta function may be a Kronecker delta function. The Kronecker delta function may include a unit impulse function having a size of '1' at n=0. In addition, in [Equation 6], K representing the number of virtual channels may be an integer.

$$P_L = \frac{W_2}{K}\sum_{k=1}^{K} h_{k,L} * \delta(n) \qquad \text{[Equation 6]}$$

$$P_R = \frac{W_2}{K}\sum_{k=1}^{K} h_{k,R} * \delta(n)$$

According to an embodiment, when the layout of a virtual channel is symmetric with respect to a listener in a virtual space, the sum of the filter coefficients of binaural filters corresponding to each of both ears of the listener may be the same. In the case of a first virtual channel and a second virtual channel symmetrical to each other based on a median plane passing through the listener, a first ipsilateral binaural filter corresponding to the first virtual channel may be the same as a second contralateral binaural filter corresponding to the second virtual channel. In addition, a first contralateral binaural filter corresponding to the first virtual channel may be the same as a second ipsilateral binaural filter corresponding to the second virtual channel. Accordingly, among binaural rendered output audio signals, a non-diegetic component PL of a left-side output audio signal L' and a non-diegetic component PR of a right-side output audio signal R' may be represented by the same audio signal. In addition, [Equation 6] described above may be represented by [Equation 7].

$$P_R = P_L = W_2 * \frac{h_o}{2} \qquad \text{[Equation 7]}$$

$$h_o = \frac{2}{K}\cdot\sum_{k=1}^{K} h_{k,L} = \frac{2}{K}\cdot\sum_{k=1}^{K} h_{k,R}$$

Here, $h_o$=sigma(from $_{k=1}$ to $^K$) $h_{k,L}$=sigma(from $_{k=1}$ to $^K$) $h_{k,R}$ In this case, when the W2 is represented as in [Equation 2] described above, an output audio signal may be represented based on the sum of 2-channel stereo signals constituting a non-diegetic channel signal. The output audio signal may be represented by [Equation 8].

$$P_R = P_L = (L_{nd} + R_{nd}) * h_o^{-1} * \frac{h_o}{2} = \frac{(L_{nd} + R_{nd})}{2} \qquad \text{[Equation 8]}$$

For example, the rendering apparatus 200 may restore a non-diegetic channel signal composed of 2 channels based on the output audio signal of [Equation 8] and the difference signal v' described above. The non-diegetic channel signal may be composed of a first channel signal Lnd and a second channel signal Rnd, which are distinguished by a channel. For example, the non-diegetic channel signal may be a 2-channel stereo signal. In this case, the difference signal v may be a signal representing the difference between the first channel signal Lnd and the second channel signal Rnd. For example, the audio signal processing apparatus 100 may generate the difference signal v based on the difference between the first channel signal Lnd and the second channel signal Rnd for each time unit in a time domain. When subtracting the second channel signal Rnd from the first channel signal Lnd, the difference signal v may be represented by [Equation 9].

$$v = \frac{(L_{nd} - R_{nd})}{2} \qquad \text{[Equation 9]}$$

Also, the rendering apparatus 200 may synthesize the difference signal v' received from the audio signal processing apparatus 100 with the output audio signals L' and R' to generate final output audio signals Lo' and Ro'. For example, the rendering apparatus 200 may add the difference signal v' to the left-side output audio signal L' and subtracts the difference signal v' from the right-side output audio signal R' to generate the final output audio signals Lo' and Ro'. In this case, the final output audio signals Lo' and Ro' may include non-diegetic channel signals Lnd and Rnd composed of 2 channels. The final output audio signal may be represented by [Equation 10]. When a non-diegetic channel signal is a mono-channel signal, a process in which the rendering apparatus 200 uses a difference signal to recover the non-diegetic channel signal may be omitted.

$$L_o = P_L + V = \frac{L_{nd} + R_{nd}}{2} + \frac{L_{nd} - R_{nd}}{2} = L_{nd} \qquad \text{[Equation 10]}$$

$$R_o = P_L - V = \frac{L_{nd} + R_{nd}}{2} - \frac{L_{nd} - R_{nd}}{2} = R_{nd}$$

Accordingly, the audio signal processing apparatus 100 may generate a non-diegetic ambisonics signal (W2, 0, 0, 0) based on the first filter described with reference to FIG. 4. Also, when the non-diegetic channel signal is a 2-channel signal, the audio signal processing apparatus 100 may generate the difference signal v as in FIG. 4. Through the above, the audio signal processing apparatus 100 may use an encoding stream of a number less than the sum of the number of signal components of an ambisonics audio signal and the number of channels of a non-diegetic channel signal to transmit a diegetic audio signal and a non-diegetic audio signal included in an input audio signal to another apparatus. For example, the sum of the number of signal components of the ambisonics signal and the number of channels of the non-diegetic channel signal may be greater than the maximum number of encoding streams. In this case, the audio signal processing apparatus 100 may combine the non-diegetic channel signal with the ambisonics signal to generate an encodable audio signal while including a non-diegetic component.

In addition, in the present embodiment, the rendering apparatus 200 is described as recovering a non-diegetic channel signal using the sum and the difference between signals, but the present disclosure is not limited thereto. When the non-diegetic channel signal may be restored using a linear combination between audio signals, the audio signal processing apparatus 100 may generate and transmit an audio signal used for the restoring. In addition, the rendering apparatus 200 may restore a non-diegetic channel signal based on an audio signal received from the audio signal processing apparatus 100.

Figure 5:
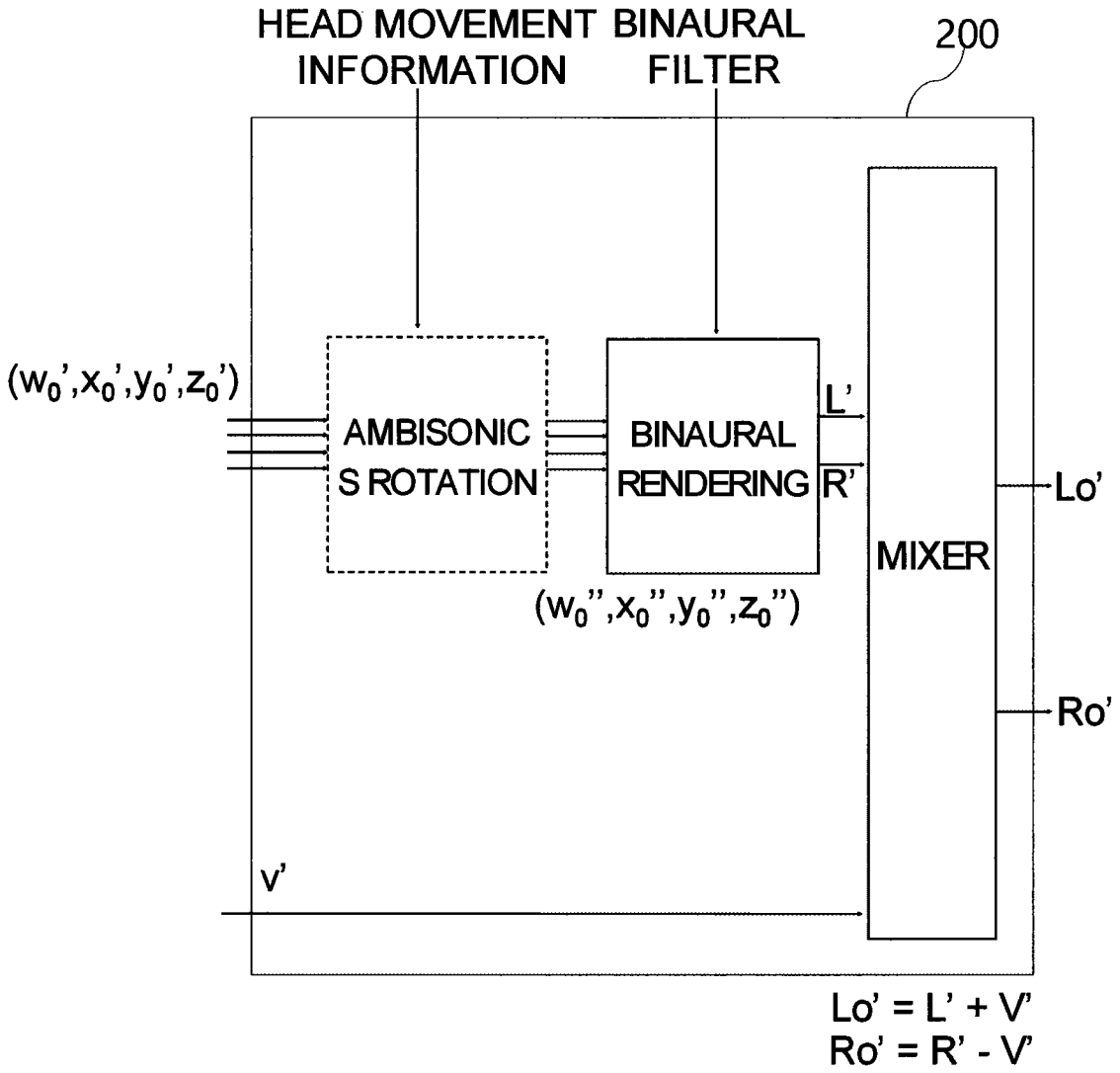
FIG. 5 is a diagram illustrating a method for generating an output audio signal including a non-diegetic channel signal based on an input audio signal including a non-diegetic ambisonics signal by a rendering apparatus according to an embodiment of the present disclosure.

In an embodiment of FIG. 5, output audio signals binaural rendered by the rendering apparatus 200 may be represented as Lout and Rout of [Equation 11]. [Equation 11] shows the binaural rendered output audio signals Lout and Rout in a frequency domain. In addition, W, X, Y, and Z may each represent a frequency domain signal component of a FoA signal. In addition, Hw, Hx, Hy, and Hz may be frequency responses of binaural filters respectively corresponding to W, X, Y, and Z signal components, respectively. In this case, a binaural filter for each signal component corresponding to each signal component may be a plurality of elements constituting the second filter described above. That is, the second filter may be represented by a combination of binaural filters corresponding to each signal component. In the present disclosure, the frequency response of a binaural filter maybe referred to a binaural transfer function. In addition, '·' may represent a multiplication operation of signals in a frequency domain.

$$Lout = W \cdot Hw + X \cdot Hx + Y \cdot Hy + Z \cdot Hz$$

$$Rout = W \cdot Hw + X \cdot Hx - Y \cdot Hy + Z \cdot Hz \qquad \text{[Equation 11]}$$

As shown in [Equation 11], the binaural rendered output audio signal may be represented as a product of the binaural transfer functions Hw, Hx, Hy, and Hz for each signal component and each signal component in a frequency domain. This is because the conversion and rendering of an ambisonics signal has a linear relationship. In addition, a first filter may be the same as an inverse filter of a binaural filter corresponding to a 0-th order signal component. This is because a non-diegetic ambisonics signal does not contain a signal corresponding to another signal component other than the 0-th order signal component.

According to an embodiment, the rendering apparatus 200 may generate an output audio signal by channel rendering on the ambisonics signal B. In this case, the audio signal processing apparatus 100 may normalize a first filter such that the magnitude of the first filter a constant frequency response. That is, the audio signal processing apparatus 100 may normalize at least one of the above-described binaural filter corresponding to the 0-th order signal component and the inverse filter thereof. In this case, the first filter may be an inverse filter of a binaural filter corresponding to a predetermined signal component among a plurality of binaural filters for each signal component included in a second filter. In addition, the audio signal processing apparatus 100 may generate a non-diegetic ambisonics signal by filtering a non-diegetic channel signal with a first filter having a frequency response of a constant magnitude. When the magnitude of the frequency response of the first filter is not constant, the rendering apparatus 200 may not be able to restore the non-diegetic channel signal. This is because when the rendering apparatus 200 performs channel rendering on the ambisonics signal, the rendering apparatus 200 does not perform rendering based on the second filter described above.

Hereinafter, for convenience of description, the operation of the audio signal processing apparatus 100 and the rendering apparatus 200 will be described with reference to FIG. 6 when a first filter is an inverse filter of a binaural filter corresponding to a predetermined signal component. This is only for convenience of description, and the first filter may be an inverse filter of an entire second filter. In this case, the audio signal processing apparatus 100 may normalize the second filter such that the frequency response of a binaural filter corresponding to a predetermined signal component in a binaural filter for each signal component included in the second filter has a constant magnitude in a frequency domain. Also, the audio signal processing apparatus 100 may generate the first filter based on the normalized second filter.

Figure 6:
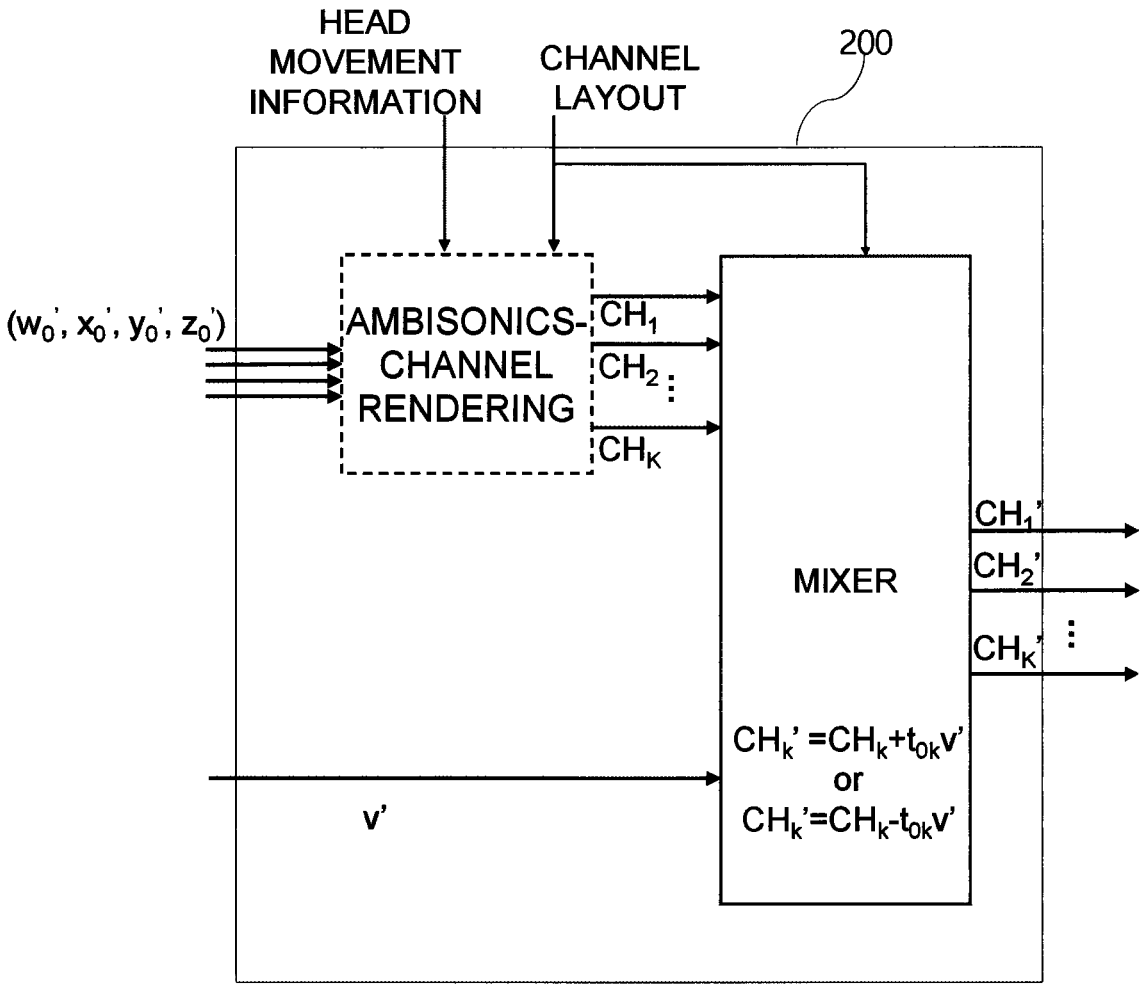
FIG. 6 is a diagram illustrating a method for generating an output audio signal by channel rendering on an input audio signal including a non-diegetic ambisonics signal by a rendering apparatus according to an embodiment of the present disclosure.

FIG. 6 is a diagram illustrating a method for generating an output audio signal by channel rendering on an input audio signal including a non-diegetic ambisonics signal by the rendering apparatus 200 according to an embodiment of the present disclosure. According to an embodiment, the rendering apparatus 200 may generate an output audio signal corresponding to each of a plurality of channels according to a channel layout. Specifically, the rendering apparatus 200 may channel rendering a non-diegetic ambisonics signal based on position information representing positions respectively corresponding to each of the plurality of channels according to a predetermined channel layout. In this case, the channel rendered output audio signal may include channel signals of a number determined according to the predetermined channel layout. When an ambisonics signal is a FoA signal, a decoding matrix T2 for converting the ambisonics signal into a loudspeaker channel signal may be represented by [Equation 12].

$$T2 = [t_{01} t_{11} t_{21} t_{31};\ t_{02} t_{12} t_{22} t_{32};\ \ldots\ t_{0K} t_{1K} t_{2K} t_{3K}] \qquad \text{[Equation 12]}$$

In [Equation 12], the number of columns of T2 may be determined based on the highest order of the ambisonics signal. Also, K may represent the number of loudspeaker channels determined according to a channel layout. For example, $t_{0K}$ may represent an element for converting a W signal component of the FoA signal to a K-th channel signal. In this case, the k-th channel signal CHk may be represented by [Equation 13]. In [Equation 13], FT(x) may mean a Fourier transform function for converting an audio signal 'x' in a time domain into a signal in a frequency domain. [Equation 13] represents a signal in a frequency domain, but the present disclosure is not limited thereto.

$$\begin{aligned} CH_k &= W1 \cdot t_{0k} + X1 \cdot t_{1k} + Y1 \cdot t_{2k} + Z_1 \cdot t_{3k} + W_2 \cdot t_{0k} = \\ &W1 \cdot t_{0k} + X1 \cdot t_{1k} + Y1 \cdot t_{2k} + Z_1 \cdot t_{3k} + \\ &FT\{(Lnd + Rnd)/2\} \cdot Hw^{-1} \cdot t_{0k} \end{aligned} \qquad \text{[Equation 13]}$$

In [Equation 12], W1, X1, Y1, and Z1 may represent a signal component of an ambisonics signal corresponding to a diegetic audio signal, respectively. For example, W1, X1, Y1, and Z1 may be signal components of the first ambisonics signal obtained in Step S302 of FIG. 3. Also, in [Equation 13], W2 may be a non-diegetic ambisonics signal. When the non-diegetic channel signal is composed of the first channel signal Lnd and the second channel signal Rnd, which are distinguished by a channel, the W2 may be represented as a value obtained by filtering a signal with the first filter, the signal which has been obtained by synthesizing the first channel signal and the second channel signal, as shown in [Equation 13]. In [Equation 13], since $Hw^{-1}$ is a filter generated based on the layout of a virtual channel, $Hw^{-1}$ and $t_{0k}$ may not be in an inverse relationship to each other. In this case, the rendering apparatus 200 can not restore the same audio signal as a first input audio signal which has been input to the audio signal processing apparatus 100. Accordingly, the audio signal processing apparatus 100 may normalize the frequency domain response of the first filter to have a constant value. Specifically, the audio signal processing apparatus 100 may set the frequency response of the first filter to have a constant value of '1'. In this case, the k-th channel signal CHk of [Equation 13] may be represented in a format in which $Hw^{-1}$ is omitted as in [Equation 14]. Through the above, the audio signal processing apparatus 100 may generate a first output audio signal allowing the rendering apparatus 200 to restore the same audio signal as the first input audio signal.

$$CH_k = W1\cdot t_{0k} + X1\cdot t_{1k} + Y1\cdot t_{2k} + Z_1\cdot t_{3k} + W_2\cdot t_{0k} = W1\cdot t_{0k} + X1\cdot t_{1k} + Y1\cdot t_{2k} + Z_1\cdot t_{3k} + FT\{(Lnd+Rnd)/2\}\cdot t_{0k} \quad \text{[Equation 14]}$$

Also, the rendering apparatus 200 may synthesize the difference signal v' received from the audio signal processing apparatus 100 with a plurality of channel signals CH1, . . . , CHk to generate second output audio signals CH1', . . . , CHk'. Specifically, the rendering apparatus 200 may mix the difference signal v' and the plurality of channel signals CH1, . . . , CHk based on position information representing positions respectively corresponding to each of a plurality of channels according to a predetermined channel layout. The rendering apparatus 200 may mix each of the plurality of channel signals CH1, . . . , CHk and the difference signal v' for each channel.

For example, the rendering apparatus 200 may determine whether to add or subtract the difference signal v' to/from a third channel signal based on the position information of the third channel signal, which is any one of the plurality of channel signals. Specifically, when the position information corresponding to the third channel signal represents the left side with respect to a median plane in a virtual space, the rendering apparatus 200 may add the third channel signal and the difference signal v' to generate a final third channel signal. In this case, the final third channel signal may include the first channel signal Lnd. The median plane may represent a plane perpendicular to a horizontal plane of the predetermined channel layout outputting the final output audio signal and having the same center with the horizontal plane.

Also, when the position information corresponding to a fourth channel signal represents the right side with respect to the median plane in a virtual space, the rendering apparatus 200 may generate a final fourth channel signal based on the difference between the difference signal v' and the fourth channel signal. In this case, the fourth channel signal may be a signal corresponding to any one channel among the plurality of channel signals which is different from the third channel. The final fourth channel signal may include the second channel signal Rnd. Also, the position information of a fifth channel signal which is different from the third channel signal and the fourth channel signal may represent a position on the median plane. In this case, the rendering apparatus 200 may not mix the fifth channel signal and the difference signal v'. [Equation 15] represents a final channel signal CHk' including each of the first channel signal Lnd and the second channel signal Rnd.

$$CH_k' = W1\cdot t_{0k} + X1\cdot t_{1k} + Y1\cdot t_{2k} + Z_1\cdot t_{3k} + FT\{(Lnd+Rnd)/2\}\cdot t_{0k} + FT\{(Lnd-Rnd)/2\}\cdot t_{0k} = W1\cdot t_{0k} + X1\cdot t_{1k} + Y1\cdot t_{2k} + Z_1\cdot t_{3k} + FT\{Lnd\}\cdot t_{0k}$$

or $$CH_k' = W1\cdot t_{0k} + X1\cdot t_{1k} + Y1\cdot t_{2k} + Z_1\cdot t_{3k} + FT\{(Lnd+Rnd)/2\}\cdot t_{0k} - FT\{(Lnd-Rnd)/2\}\cdot t_{0k} = W1\cdot t_{0k} + X1\cdot t_{1k} + Y1\cdot t_{2k} + Z_1\cdot t_{3k} + FT\{Rnd\}\cdot t_{0k} \quad \text{[Equation 15]}$$

In the embodiment described above, the first channel and the second channel are described as corresponding to each of the left side and the right side with respect to the median plane, but the present disclosure is not limited thereto. For example, the first channel and the second channel may be channels respectively corresponding to regions different from each other with respect to a plane dividing a virtual space into two regions.

Meanwhile, according to an embodiment, the rendering apparatus 200 may generate an output audio signal using a normalized binaural filter. For example, the rendering apparatus 200 may receive an ambisonics signal including a non-diegetic ambisonics signal generated based on the normalized first filter described above. For example, the rendering apparatus 200 may normalize a binaural transfer function corresponding to another order signal component based on a binaural transfer function corresponding to an ambisonics 0-th order signal component. In this case, the rendering apparatus 200 may binaural render an ambisonics signal based on a binaural filter normalized in a same manner as a manner in which the audio signal processing apparatus 100 normalized the first filter. The normalized binaural filter can be signaled to another apparatus from one of the audio signal processing apparatus 100 and the rendering device 200. Alternatively, the rendering apparatus 200 and the audio signal processing apparatus 100 may generate a normalized binaural filter in a common manner, respectively. [Equation 16] represents an embodiment for normalizing a binaural filter. In [Equation 16], Hw0, Hx0, Hy0, and Hz0 may be binaural transfer functions corresponding to W, X, Y, and Z signal components of a FoA signal, respectively. In addition, Hw, Hx, Hy, and Hz may be a normalized binaural transfer function for each signal component corresponding to W, X, Y, and Z signal components.

$$Hw = Hw0/Hw0$$

$$Hx = Hx0/Hw0$$

$$Hy = Hy0/Hw0$$

$$Hz = Hz0/Hw0 \quad \text{[Equation16]}$$

As in [Equation 16], the normalized binaural filter may be in the form in which a binaural transfer function for each signal component is divided by $Hw_0$ which is a binaural transfer function corresponding to a predetermined signal component. However, the normalization method is not limited thereto. For example, the rendering apparatus 200 may normalize a binaural filter based on a magnitude of $|Hw_0|$.

Meanwhile, in a small device such as a mobile device, it is difficult to support various kinds of encoding/decoding methods, depending on the limited computational ability and memory size of the small device. This may be the same for some large devices as well as small devices. For example, at least one of the audio signal processing apparatus 100 and the rendering apparatus 200 may support only a 5.1 channel codec for encoding a 5.1 channel signal. In this case, the audio signal processing apparatus 100 may have difficulty in transmitting four or more object signals and 2-channel or more non-diegetic channel signals together. In addition, when the rendering apparatus 200 receives data corresponding to a FoA signal and a 2-channel non-diegetic channel signal, the rendering apparatus 200 may have difficulty in rendering all the received signal components. This is because the rendering apparatus 200 cannot decode an encoding stream exceeding 5 encoding streams using a 5.1 channel codec.

The audio signal processing apparatus 100 according to an embodiment of the present disclosure may reduce the number of channels of a 2-channel non-diegetic channel signals by the above-described method. Through the above, the audio signal processing apparatus 100 may transmit audio data encoded using a 5.1 channel codec to the rendering apparatus 200. In this case, the audio data may include data for reproducing a non-diegetic sound. Hereinafter, a method in which the audio signal processing apparatus 100 transmits a non-diegetic channel signal composed of 2 channels with a FoA signal using a 5.1 channel codec will be described with reference to FIG. 7.

Figure 7:
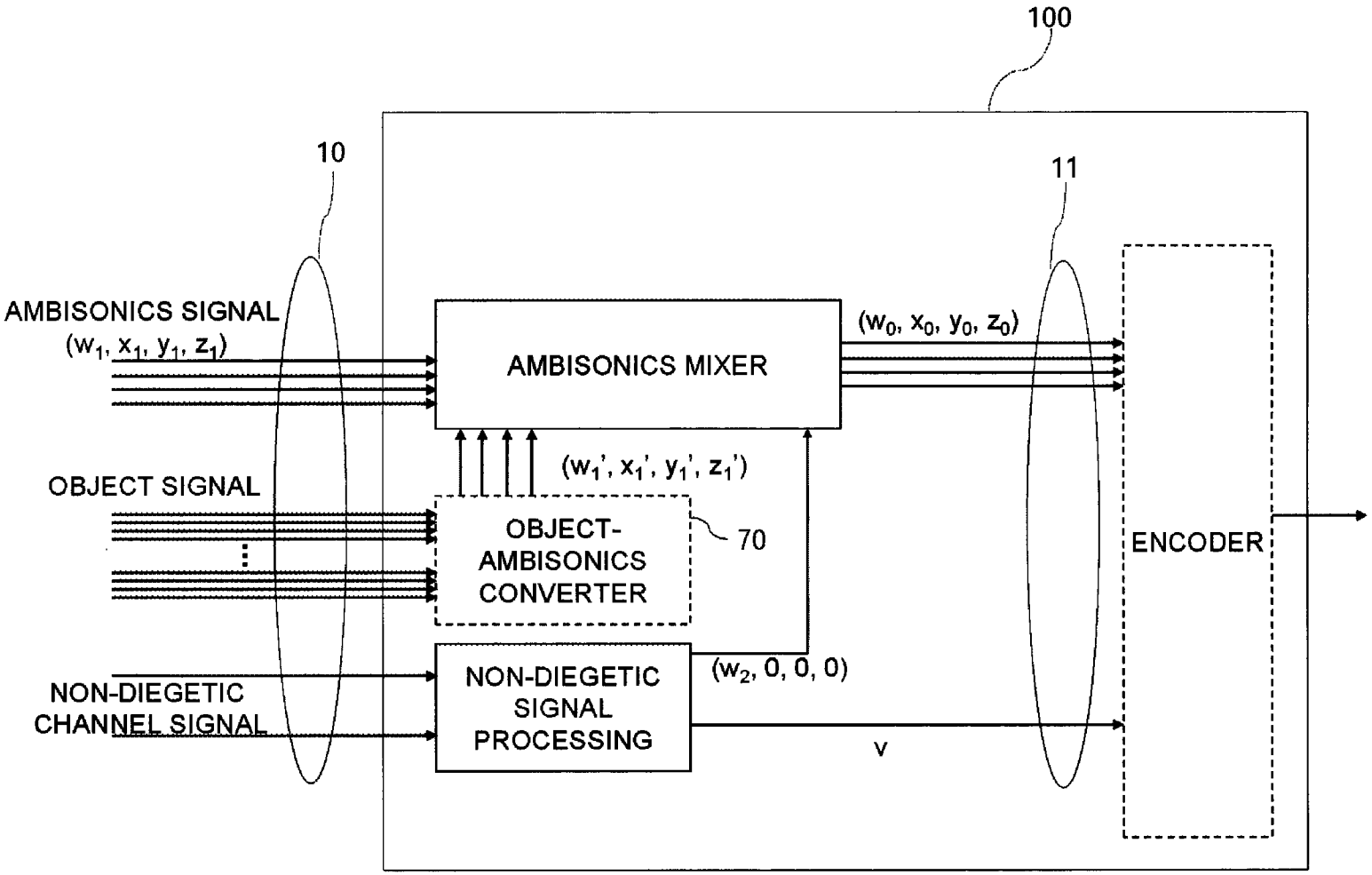
FIG. 7 is a diagram illustrating an operation of an audio signal processing apparatus when the audio signal processing apparatus supports a codec for encoding a 5.1 channel signal according to an embodiment of the present disclosure.

FIG. 7 is a diagram illustrating an operation of the audio signal processing apparatus 100 when the audio signal processing apparatus 100 supports a codec for encoding a 5.1 channel signal according to an embodiment of the present disclosure. A 5.1 channel sound output system may represent a sound output system composed of a total five full-band speakers and a woofer speaker arranged at the front left and right, center, and the rear left and right. Also, a 5.1 channel codec may be a means for encoding/decoding an audio signal input or output to a corresponding sound output system. However, in the present disclosure, the 5.1 channel codec may be used by the audio signal processing apparatus 100 to encode/decode an audio signal not on the premise of playback in the 5.1 channel sound output system. For example, in the present disclosure, the 5.1 channel codec may be used by the audio signal processing apparatus 100 to encode an audio signal having the same number of full-band channel signals constituting the audio signal as the number of channel signals constituting a 5.1 channel signal. Accordingly, a signal component or a channel signal corresponding to each of the five encoding streams may not be an audio signal output through the 5.1 channel sound output system.

Referring to FIG. 7, the audio signal processing apparatus 100 may generate a first output audio signal based on a first FoA signal composed of four signal components and a non-diegetic channel signal composed of 2-channel. In this case, the first output audio signal may be an audio signal composed of 5 signal components corresponding to 5 encoding streams. The audio signal processing apparatus 100 may generate a second FoA signal (w2, 0, 0, 0) based on a non-diegetic channel signal. The audio signal processing apparatus 100 may synthesize the first FoA signal and the second FoA signal. Also, the audio signal processing apparatus 100 may assign each of the four signal components of a signal obtained by synthesizing the first FoA signal and the second FoA signal to four encoding streams of the 5.1 channel codec. Also, the audio signal processing apparatus 100 may assign a difference signal between non-diegetic channel signals to one encoding stream. The audio signal processing apparatus 100 may encode the first output audio signal assigned to each of the 5 encoding streams using the 5.1 channel codec. Also, the audio signal processing apparatus 100 may transmit the encoded audio data to the rendering apparatus 200.

In addition, the rendering apparatus 200 may receive the encoded audio data from the audio signal processing apparatus 100. The rendering apparatus 200 may decode audio data encoded based on the 5.1 channel codec to generate an input audio signal. The rendering apparatus 200 may output a second output audio signal by rendering the input audio signal.

Meanwhile, according to an embodiment, the audio signal processing apparatus 100 may receive an input audio signal including an object signal. In this case, the audio signal processing apparatus 100 may transform the object signal to an ambisonics signal. In this case, the highest order of the ambisonics signal may be less than or equal to the highest order of a first ambisonics signal included in the input audio signal. This is because when an output audio signal includes an object signal, the efficiency of encoding an audio signal and the efficiency of transmitting encoded data may be reduced. For example, the audio signal processing apparatus 100 may include an object-ambisonics converter 70. The object-ambisonics converter of FIG. 7 may be implemented through a processor to be described later as with other operations of the audio signal processing apparatus 100.

Specifically, when the audio signal processing apparatus 100 encodes using an independent encoding stream for each object, the audio signal processing apparatus 100 may be limited in encoding according to an encoding method. This is because the number of encoding streams may be limited according to an encoding method. Accordingly, the audio signal processing apparatus 100 may convert an object signal into an ambisonics signal and then transmit the converted signal. This is because, in the case of an ambisonics signal, the number of signal components is limited to a predetermined number according to the order of an ambisonics format. For example, the audio signal processing apparatus 100 may convert an object signal into an ambisonics signal based on position information representing the position of an object corresponding to the object signal.

Figure 8:
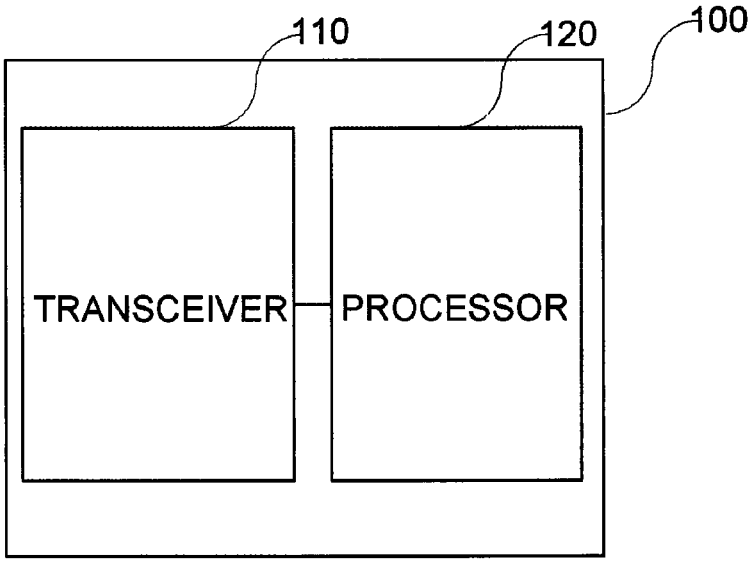
FIG. 8 and FIG. 9 are block diagrams illustrating a configuration of an audio signal processing apparatus and a rendering apparatus according to an embodiment of the present disclosure.
Figure 9:
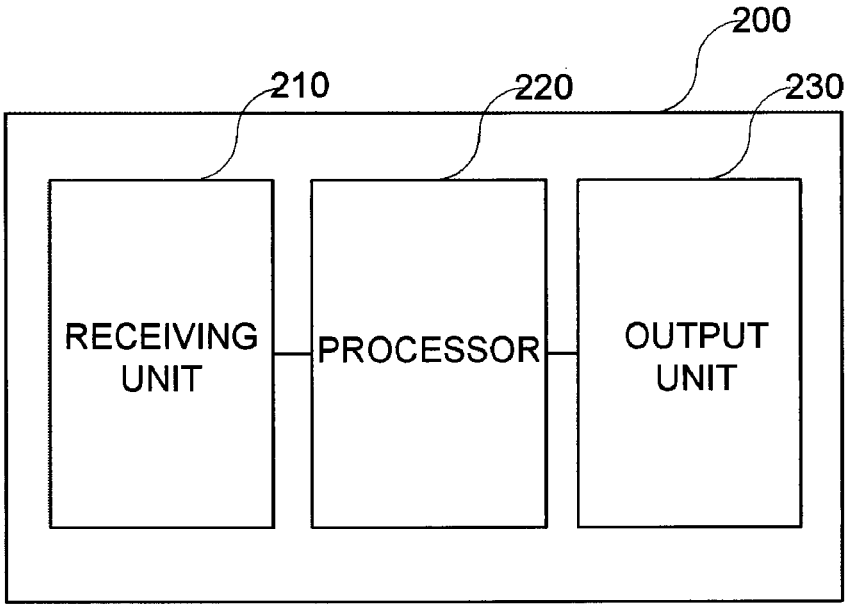

FIG. 8 and FIG. 9 are block diagrams illustrating the configurations of the audio signal processing apparatus 100 and the rendering apparatus 200 according to an embodiment of the present disclosure. Some of the components illustrated in FIG. 8 and FIG. 9 may be omitted, and the audio signal processing apparatus 100 and the rendering apparatus 200 may further include components not shown in FIG. 8 and FIG. 9. Also, each apparatus may be integrally provided with at least two components different from each other. According to an embodiment, the audio signal processing apparatus 100 and the rendering apparatus 200 may be implemented as a single semiconductor chip, respectively.

Referring to FIG. 8, the audio signal processing apparatus 100 may include a transceiver 110 and a processor 120. The transceiver 110 may receive an input audio signal input to the audio signal processing apparatus 100. The transceiver 110 may receive an input audio signal to be subjected to audio signal processing by the processor 120. In addition, the transceiver 110 may transmit an output audio signal generated in the processor 120. Here, the input audio signal and the output audio signal may include at least one of an ambisonics signal and a channel signal.

According to an embodiment, the transceiver 110 may be provided with a transmitting/receiving means for transmitting/receiving an audio signal. For example, the transceiver 110 may include an audio signal input/output terminal for transmitting/receiving an audio signal transmitted by wire. The transceiver 110 may include a wireless audio transmitting/receiving module for transmitting/receiving an audio signal transmitted wirelessly. In this case, the transceiver 110 may receive the audio signal transmitted wirelessly using a wireless communication method such as Bluetooth or Wi-Fi.

According to an embodiment, when the audio signal processing apparatus 100 includes at least one of a separate encoder and a decoder, the transceiver 110 may transmit/receive a bitstream in which an audio signal is encoded. In this case, the encoder and the decoder may be implemented through the processor 120 to be described later. Specifically, the transceiver 110 may include one or more components which enables communication with other apparatus external to the audio signal processing apparatus 100. In this case, the other apparatus may include the rendering apparatus 200. In addition, the transceiver 110 may include at least one antenna for transmitting encoded audio data to the rendering apparatus 200. Also, the transceiver 110 may be provided with hardware for wired communication for transmitting the encoded audio data.

The processor 120 may control the overall operation of the audio signal processing apparatus 100. The processor 120 may control each component of the audio signal processing apparatus 100. The processor 120 may perform operations and processing of various data and signals. The processor 120 may be implemented as hardware in the form of a semiconductor chip or an electronic circuit or as software controlling hardware. The processor 120 may be implemented in the form in which hardware and the software are combined. For example, the processor 120 may control the operation of the transceiver 110 by executing at least one program included in software. Also, the processor 120 may execute at least one program to perform the operation of the audio signal processing apparatus 100 described above with reference to FIG. 1 to FIG. 7.

For example, the processor 120 may generate an output audio signal from an input audio signal received through the transceiver 110. Specifically, the processor 120 may generate a non-diegetic ambisonics signal based on a non-diegetic channel signal. In this case, the non-diegetic ambisonics signal may be an ambisonics signal including only a signal corresponding to a predetermined signal component among a plurality of signal components included in the ambisonics signal. Also, the processor 120 may generate an ambisonics signal whose signal of a signal component other than a predetermined signal component is zero. The processor 120 may filter the non-diegetic channel signal with the first filter described above to generate the non-diegetic ambisonics signal.

In addition, the processor 120 may synthesize a non-diegetic ambisonics signal and an input ambisonics signal to generate an output audio signal. Also, when the non-diegetic channel signal is composed of 2-channel, the processor 120 may generate a difference signal representing the difference between channel signals constituting the non-diegetic channel signal. In this case, the output audio signal may include a difference signal and an ambisonics signal obtained by synthesizing the non-diegetic ambisonics signal and the input ambisonics signal. Also, the processor 120 may encode an output audio signal to generate encoded audio data. The processor 120 may transmit the generated audio data through the transceiver 110.

Referring to FIG. 9, the rendering apparatus 200 according to an embodiment of the present disclosure may include a receiving unit 210, a processor 220, and an output unit 230. The receiving unit 210 may receive an input audio signal input to the rendering apparatus 200. The receiving unit 210 may receive an input audio signal to be subjected to audio signal processing by the processor 220. According to an embodiment, the receiving unit 210 may be provided with a receiving means for receiving an audio signal. For example, the receiving unit 210 may include an audio signal input/output terminal for receiving an audio signal transmitted by wire. The receiving unit 210 may include a wireless audio receiving module for transmitting/receiving an audio signal transmitted wirelessly. In this case, the receiving unit 210 may receive the audio signal transmitted wirelessly using a wireless communication method such as Bluetooth or Wi-Fi.

According to an embodiment, when the rendering apparatus 200 includes a separate decoder, the receiving unit 210 may transmit/receive a bitstream in which an audio signal is encoded. In this case, the decoder may be implemented through the processor 220 to be described later. Specifically, the receiving unit 210 may include one or more components which enables communication with another apparatus external to the rendering apparatus 200. In this case, another apparatus may include the audio signal processing apparatus 100. In addition, the receiving unit 210 may include at least one antenna for receiving encoded audio data from the audio signal processing apparatus 100. Also, the receiving unit 210 may be provided with hardware for wired communication for receiving the encoded audio data.

The processor 220 may control the overall operation of the rendering apparatus 200. The processor 220 may control each component of the rendering apparatus 200. The processor 220 may perform operations and processing of various data and signals. The processor 220 may be implemented as hardware in the form of a semiconductor chip or an electronic circuit or as software controlling hardware. The processor 220 may be implemented in the form in which hardware and the software are combined. For example, the processor 220 may control the operation of the receiving unit 210 and the output unit 230 by executing at least one program included in software. Also, the processor 220 may execute at least one program to perform the operation of the rendering apparatus 200 described above with reference to FIG. 1 to FIG. 7.

According to an embodiment, the processor 220 may generate an output audio signal by rendering an input audio signal. For example, the input audio signal may include an ambisonics signal and a difference signal. Here, the ambisonics signal may include the non-diegetic ambisonics signal described above. In addition, the non-diegetic ambisonics signal may be a signal generated based on a non-diegetic channel signal. Also, the difference signal may be a signal representing the difference between channel signals of a non-diegetic channel signal composed of 2-channel. According to an embodiment, the processor 220 may binaural render an input audio signal. The processor 220 may binaural render an ambisonics signal to generate a 2-channel binaural audio signal corresponding to each of both ears of the listener. In addition, the processor 220 may output an output audio signal generated through the output unit 230.

The output unit 230 may output an output audio signal. For example, the output unit 230 may output an output audio signal generated by the processor 220. The output unit 230 may include at least one output channel. Here, the output audio signal may be a 2-channel output audio signal corresponding to each of both ears of the listener. Here, the output audio signal may be a binaural 2-channel output audio signal. The output unit 230 may output a 3D audio headphone signal generated by the processor 220.

According to an embodiment, the output unit 230 may be provided with an output means for outputting an output audio signal. For example, the output unit 230 may include an output terminal for outputting an output audio signal to the outside. In this case, the rendering apparatus 200 may output the output audio signal to an external device connected to the output terminal. Alternatively, the output unit 230 may include a wireless audio transmitting/receiving module for outputting an output audio signal to the outside. In this case, the output unit 230 may output the output audio signal to the external device using a wireless communication method such as Bluetooth or Wi-Fi. Alternatively, the output unit 230 may include a speaker. In this case, the rendering apparatus 200 may output an output audio signal through the speaker. Specifically, the output unit 230 may include a plurality of speakers arranged according to a predetermined channel layout. In addition, the output unit 230 may additionally include a converter which converts a digital audio signal to an analogue audio signal (for example, a digital-to-analog converter (DAC)).

Some embodiments may also be implemented in the form of a recording medium including instructions executable by a computer, such as a program module executed by the computer. A computer-readable medium may be any available medium which may be accessed by a computer and may include both volatile and non-volatile media and detachable and non-detachable media. In addition, the computer-readable medium may include a computer storage medium. The computer storage medium may include both volatile and non-volatile media and detachable and non-detachable media implemented by any method or technology for the storage of information such as computer readable instructions, data structures, program modules or other data.

In addition, in the present disclosure, a "unit" may be a hardware component such as a processor or a circuit, and/or a software component executed by a hardware component such as a processor.

While the present disclosure has been described with reference to specific embodiments thereof, those skilled in the art may make modifications and changes without departing from the spirit and scope of the present disclosure. That is, although the present disclosure has been described with respect to an embodiment of performing binaural rendering on an audio signal, the present disclosure is equally applicable and extendable to various multimedia signals including video signals as well as audio signals. Therefore, it will be readily understood by those skilled in the art that various modifications and changes can be made thereto without departing from the spirit and scope of the present invention defined by the appended claims.

What is claimed is:

1. An audio signal processing apparatus for generating an output audio signal, the audio signal processing apparatus comprising a processor configured to:

obtain an input audio signal comprising a first ambisonics signal and a non-diegetic channel signal;

generate a second ambisonics signal comprising only a signal corresponding to a predetermined signal component among a plurality of signal components included in an ambisonics format of the first ambisonics signal based on the non-diegetic channel signal; and generate an output audio signal including a third ambisonics signal obtained by synthesizing the second ambisonics signal and the first ambisonics signal for each signal component, wherein the non-diegetic channel signal represents an audio signal forming an audio scene fixed with respect to a listener, and the predetermined signal component is a signal component representing the sound pressure of a sound field at a point at which an ambisonics signal has been collected.

2. The audio signal processing apparatus of claim 1, wherein the processor is configured to filter the non-diegetic channel signal with a first filter to generate the second ambisonics signal, and wherein the first filter is an inverse filter of a second filter for binaural rendering the third ambisonics signal into an output audio signal in an output device which has received the third ambisonics signal.

3. The audio signal processing apparatus of claim 2, wherein the processor is configured to obtain information on a plurality of virtual channels arranged in a virtual space in which the output audio signal is simulated and generate the first filter based on the information of the plurality of virtual channels, and wherein the information of the plurality of virtual channels is used for rendering the third ambisonics signal.

4. The audio signal processing apparatus of claim 1, wherein the non-diegetic channel signal is a 2-channel signal composed of a first channel signal and a second channel signal, and wherein the processor is configured to generate a difference signal between the first channel signal and the second channel signal, and generate the output audio signal comprising the difference signal and the third ambisonics signal.

5. The audio signal processing apparatus of claim 4, wherein the processor is configured to encode the output audio signal to generate a bitstream, and transmit the generated bitstream to an output device, wherein the output device is a device for rendering an audio signal generated by decoding the bitstream, and wherein when the number of encoding streams used for the generation of the bitstream is N, the output audio signal comprises the third ambisonics signal composed of N−1 signal components corresponding to N−1 encoding streams and the difference signal corresponding to one encoding stream.

6. The audio signal processing apparatus of claim 5, wherein the maximum number of encoding streams supported by a codec used for the generation of the bitstream is five.

7. An audio signal processing apparatus for rendering an input audio signal, the audio signal processing apparatus comprising a processor configured to:

obtain an input audio signal comprising an ambisonics signal and a non-diegetic channel difference signal;

render the ambisonics signal to generate a first output audio signal;

mix the first output audio signal and the non-diegetic channel difference signal to generate a second output audio signal; and output the second output audio signal;

wherein the non-diegetic channel difference signal is a difference signal representing a difference between a first channel signal and a second channel signal constituting a 2-channel audio signal, and the first channel signal and the second channel signal are audio signals forming an audio scene fixed with respect to a listener.

8. The audio signal processing apparatus of claim 7, wherein the ambisonics signal comprises a non-diegetic ambisonics signal generated based on a signal obtained by synthesizing the first channel signal and the second channel signal, wherein the non-diegetic ambisonics signal comprises only a signal corresponding to a predetermined signal component among a plurality of signal components included in an ambisonics format of the ambisonics signal, and wherein the predetermined signal component is a signal component representing the sound pressure of a sound field at a point at which an ambisonics signal has been collected.

9. The audio signal processing apparatus of claim 8, wherein the non-diegetic ambisonics signal is a signal obtained by filtering, with a first filter, a signal which has been obtained by synthesizing the first channel signal and the second channel signal, and wherein the first filter is an inverse filter of a second filter which is for binaural rendering the ambisonics signal into the first output audio signal.

10. The audio signal processing apparatus of claim 9, wherein the first filter is generated based on information on a plurality of virtual channels arranged in a virtual space in which the first output audio signal is simulated.

11. The audio signal processing apparatus of claim 10, wherein the information of the plurality of virtual channels comprises position information representing the position of each of the plurality of virtual channels, wherein the first filter is generated based on a plurality of binaural filters corresponding to the position of each of the plurality of virtual channels, and wherein the plurality of binaural filters are determined based on the position information.

12. The audio signal processing apparatus of claim 11, wherein the first filter is generated based on the sum of filter coefficients included in the plurality of binaural filters.

13. The audio signal processing apparatus of claim 12, wherein the first filter is generated based on the result of an inverse operation of the sum of the filter coefficients and a number of the plurality of virtual channels.

14. The audio signal processing apparatus of claim 11, wherein the processor is configured to: binaural render the ambisonics signal based on the information of the plurality of virtual channels arranged in the virtual space to generate the first output audio signal; and mix the first output audio signal and the non-diegetic channel difference signal to generate the second output audio signal.

15. The audio signal processing apparatus of claim 9, wherein the second filter comprises a plurality of binaural filters for each signal component respectively corresponding to each signal component included in the ambisonics signal, wherein the first filter is an inverse filter of a binaural filter corresponding to the predetermined signal component among the plurality of binaural filters for each signal component, and wherein a frequency response of the first filter has a constant magnitude in a frequency domain.

16. The audio signal processing apparatus of claim 8, wherein the second output audio signal comprises a plurality of output audio signals respectively corresponding to each of a plurality of channels according to a predetermined channel layout, and wherein the processor is configured to:

generate the first output audio signal comprising a plurality of output channel signals respectively corresponding to each of the plurality of channels by channel rendering the ambisonics signal based on position information representing positions respectively corresponding to each of the plurality of channels; and for each of the plurality of channels, generate the second output audio signal by mixing the first output audio signal and the non-diegetic channel difference signal based on the position information, wherein each of the plurality of output channel signals comprises an audio signal obtained by synthesizing the first channel signal and the second channel signal.

17. The audio signal processing apparatus of claim 16, wherein a median plane represents a plane perpendicular to a horizontal plane of the predetermined channel layout and having the same center with the horizontal plane, and wherein the processor is configured to generate the second output audio signal by mixing the non-diegetic channel difference signal with the first output audio signal in a different manner for each of a channel corresponding to a left side with respect to the median plane, a channel corresponding to a right side with respect to the median plane, and a channel corresponding to the median plane among the plurality of channels.

18. The audio signal processing apparatus of claim 8, wherein the first channel signal and the second channel signal are channel signals corresponding to different regions with respect to a plane dividing a virtual space in which the second output audio signal is simulated into two regions.

19. A method for operating an audio signal processing apparatus for rendering an input audio signal, the method comprising:

obtaining an input audio signal comprising an ambisonics signal and a non-diegetic channel difference;

rendering the ambisonics signal to generate a first output audio signal;

mixing the first output audio signal and the non-diegetic channel difference signal to generate a second output audio signal; and outputting the second output audio signal, wherein the non-diegetic channel difference signal is a difference signal representing a difference between a first channel signal and a second channel signal constituting a 2-channel audio signal, and the first channel signal and the second channel signal are audio signals forming an audio scene fixed with respect to a listener.

20. An electronic device readable recording medium in which a program for executing the method of claim 19 in an electronic device is recorded.

* * * * *